US009673560B2

(12) United States Patent
Iihoshi et al.

(10) Patent No.: US 9,673,560 B2
(45) Date of Patent: Jun. 6, 2017

(54) LAMINATED CONNECTOR

(71) Applicant: Sumitomo Wiring Systems, Ltd., Yokkaichi, Mie (JP)

(72) Inventors: Shinji Iihoshi, Mie (JP); Toshikazu Sakurai, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/058,204

(22) Filed: Mar. 2, 2016

(65) Prior Publication Data

US 2016/0285193 A1 Sep. 29, 2016

(30) Foreign Application Priority Data

Mar. 25, 2015 (JP) ..... 2015-062571

(51) Int. Cl.

| | |
|---|---|
| ***H01R 13/514*** | (2006.01) |
| ***H01R 13/40*** | (2006.01) |
| ***H01R 13/436*** | (2006.01) |
| *H01R 13/502* | (2006.01) |

(52) U.S. Cl.

CPC ..... *H01R 13/514* (2013.01); *H01R 13/4361* (2013.01); *H01R 13/502* (2013.01)

(58) Field of Classification Search

CPC H01R 13/514; H01R 13/4361; H01R 13/506; H01R 13/4362; H01R 13/40

USPC ..... 439/701, 752

See application file for complete search history.

(56) References Cited

U.S. PATENT DOCUMENTS

| | | | | |
|---|---|---|---|---|
| 7,572,154 | B2 * | 8/2009 | Ichio | H01R 13/4361 361/735 |
| 7,695,315 | B2 * | 4/2010 | Hitchcock | H01R 13/4223 439/541.5 |
| 2001/0010986 | A1 * | 8/2001 | Maeda | H01R 13/514 439/701 |
| 2002/0115354 | A1 * | 8/2002 | Sato | H01R 13/533 439/701 |
| 2007/0072492 | A1 * | 3/2007 | Kobayashi | H01R 13/4361 439/701 |
| 2007/0202753 | A1 | 8/2007 | Murakami et al. | |
| 2011/0014820 | A1 * | 1/2011 | Ito | H01R 13/4361 439/701 |

* cited by examiner

*Primary Examiner* — Gary Paumen

(74) *Attorney, Agent, or Firm* — Gerald E. Hespos; Michael J. Porco; Matthew T. Hespos

(57) ABSTRACT

A laminated connector (1) includes a plurality of housings (2) in which terminal accommodating chambers (6) for accommodating terminal fittings (4) are arranged side by side in a predetermined direction and is structured such that the housings (2) are laminated. The laminated connector (1) includes at least a first housing (10) and a second housing (20) as the plurality of housings (2). A projection (first projections (14)) of the first housing (10) is inserted into a recess (second recesses (28)) of the second housing (20), arranged over a plurality of the terminal accommodating chambers (6) in the second housing (20) and capable of regulating movements of the respective terminal fittings (4) accommodated in the terminal accommodating chambers (6) at a position, where the projection is arranged, in a pull-out direction.

5 Claims, 5 Drawing Sheets

LAMINATED CONNECTOR

BACKGROUND

1. Field of the Invention

The invention relates to a laminated connector.

2. Description of the Related Art

US Patent Application Publication No. 2007/0202753 discloses a laminated joint connector formed by laminating a plurality of connector housings. This laminated joint connector has an insertion-side connector configured as a united structure obtained by laminating connector housings. Each housing has connection terminals accommodated in terminal accommodating chambers provided side by side in plural stages. A double locking structure is provided for locking the connection terminals in the respective terminal accommodating chambers of the connector housings. The double locking structure has double-locking ribs formed on the mating connector housing to be laminated in addition to a structure for locking lock receiving portions by locking lances. However, the laminated connector has one double-locking rib inserted into one terminal accommodating chamber and each rib has to be narrow. Thus, the rib may be difficult to provide a wide strong rib. A strong rib is a particular concern if the size of the terminal accommodating chambers becomes smaller such as due to a reduction in the entire size of the connector and the terminal.

The invention was developed based on the above situation and aims to provide a configuration capable of regulating terminal fittings accommodated in a housing by a part of another housing and easily enhancing the strength of that regulating part.

SUMMARY

The invention is directed to a laminated connector with a plurality of housings. Each housing has terminal accommodating chambers arranged side by side for accommodating terminal fittings. The housings are laminated so that a first wall of a first housing is coupled to a second wall of a second housing. A projection is formed on the first wall of the first housing and a recess is formed on the second wall of the second housing. The projection of the first housing is inserted into the recess of the second housing and enters the terminal accommodating chambers in the second housing to regulate movement of the respective terminal fittings in the terminal accommodating chambers in a pull-out direction.

The projection of the first housing can have a width that extends over the plurality of terminal accommodating chambers in the second housing and can act on the terminal fittings accommodated in the terminal accommodating chambers. Thus, the strength of the projection is enhanced easily even if the housings and the terminal accommodating chambers are made small in a situation where miniaturization is desired.

The first housing may be formed with a first projection and a first recess adjacent to each other on the first wall. The second housing may be formed with a second recess and a second projection adjacent to each other on the second wall. In this configuration, the first projection of the first housing is inserted into the second recess of the second housing to enter the terminal accommodating chambers in the second housing for regulating movements of the respective terminal fittings in the terminal accommodating chambers in the pull-out direction. Further, the second projection of the second housing is inserted into the first recess of the first housing to enter the terminal accommodating chambers in the first housing for regulating movements of the respective terminal fittings in the terminal accommodating chambers in the pull-out direction. With this configuration, the first projection functions to retain the terminal fittings of the second housing and the second projection functions to retain the terminal fittings of the first housing. The two housings interact so that the projection on each housing retains the terminal fittings of the mating housing, and so that the terminal fittings can be locked efficiently in both housings. In addition, the first and second projections have widths to extend over the plurality of terminal accommodating chambers in the mating housing and to lock the plurality of terminal fittings. Thus, the strength of the projections is enhanced easily.

One of the housings may be an end housing arranged on an end of the laminated connector in a laminating direction. Thus, there is no need for a dedicated lid with a locking structure but no terminal accommodating chambers on the end in the laminating direction. Accordingly, the number of components is reduced and miniaturization can be realized easily.

A resiliently deformable protuberance may be formed on an outer surface of the projection. The protuberance on the projection may be caught in the second housing in an inserted state where the projection is inserted in the recess, thereby regulating a relative movement of the projection with respect to the recess in a separating direction. Thus, the projection functions to retain the terminal fittings, and a part of the projection maintains a fitting structure. Accordingly, even in the absence of a dedicated component for maintaining the coupling of the housings, a stable coupled state of the housings is maintained easily by a fitted state of the projection and the recess and the catching engagement of the protuberance. Therefore, the structure for maintaining the coupling of the housings is not large and complicated.

DETAILED DESCRIPTION

Figure 1:
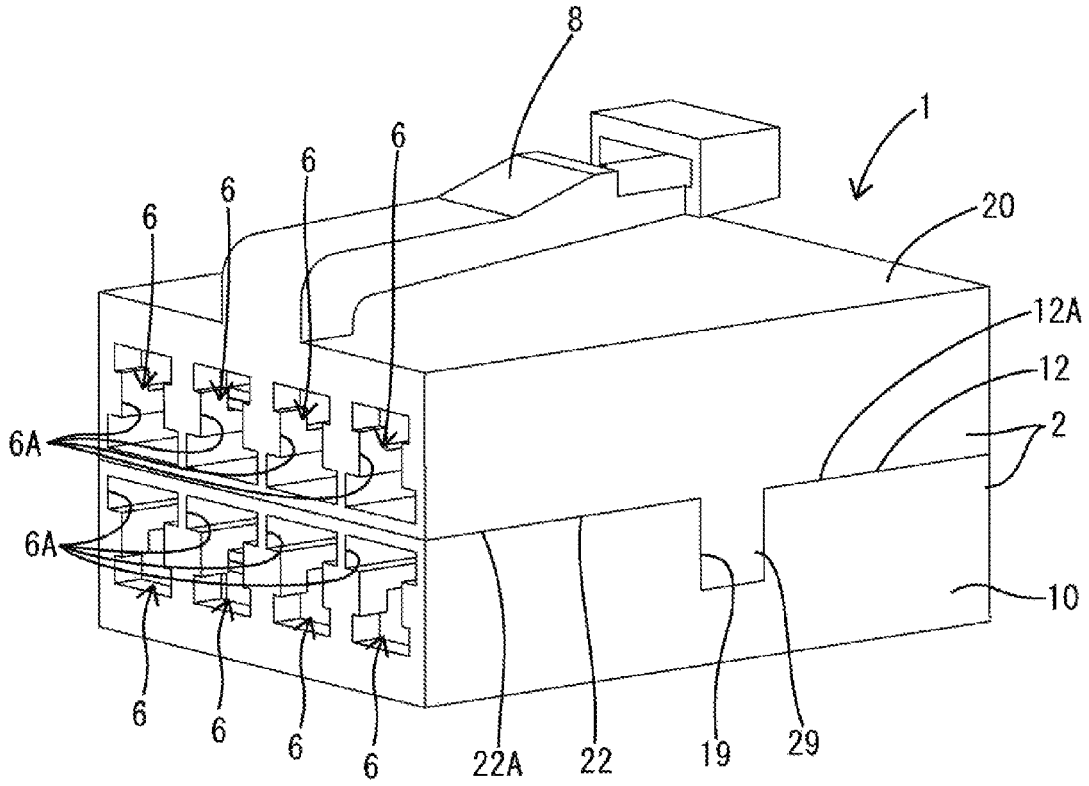
FIG. 1 is a perspective view showing a state where a first housing and a second housing are coupled in a laminated connector according to an embodiment of the invention.
Figure 3:
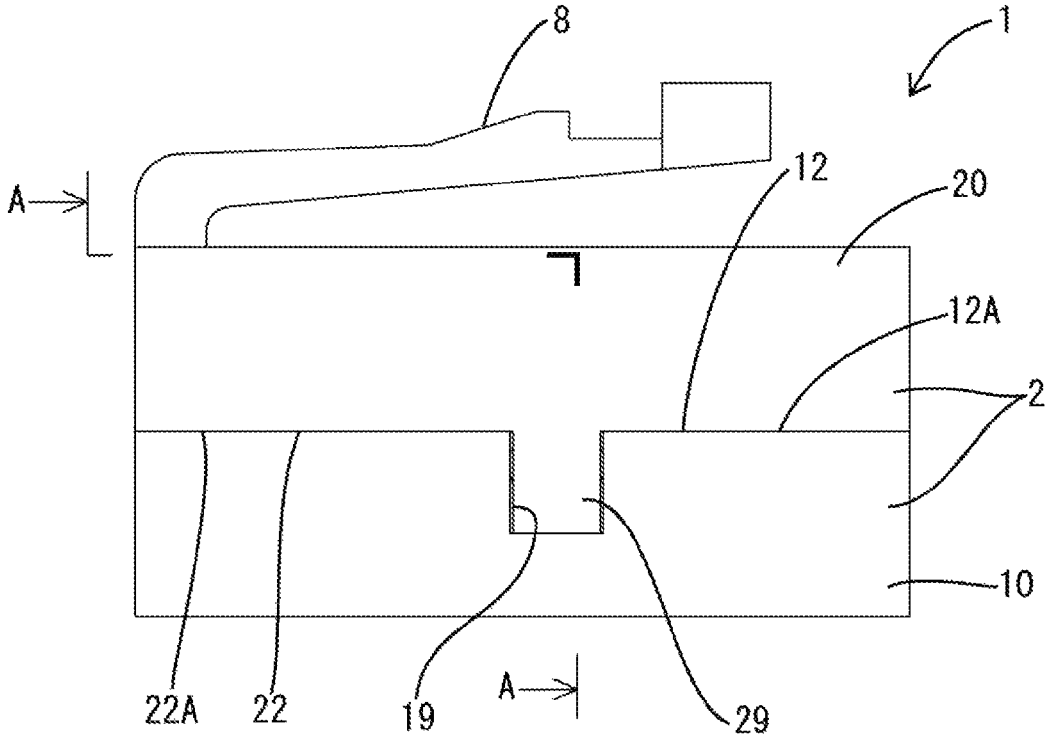
FIG. 3 is a side view of the laminated connector of FIG. 1.
Figure 4:
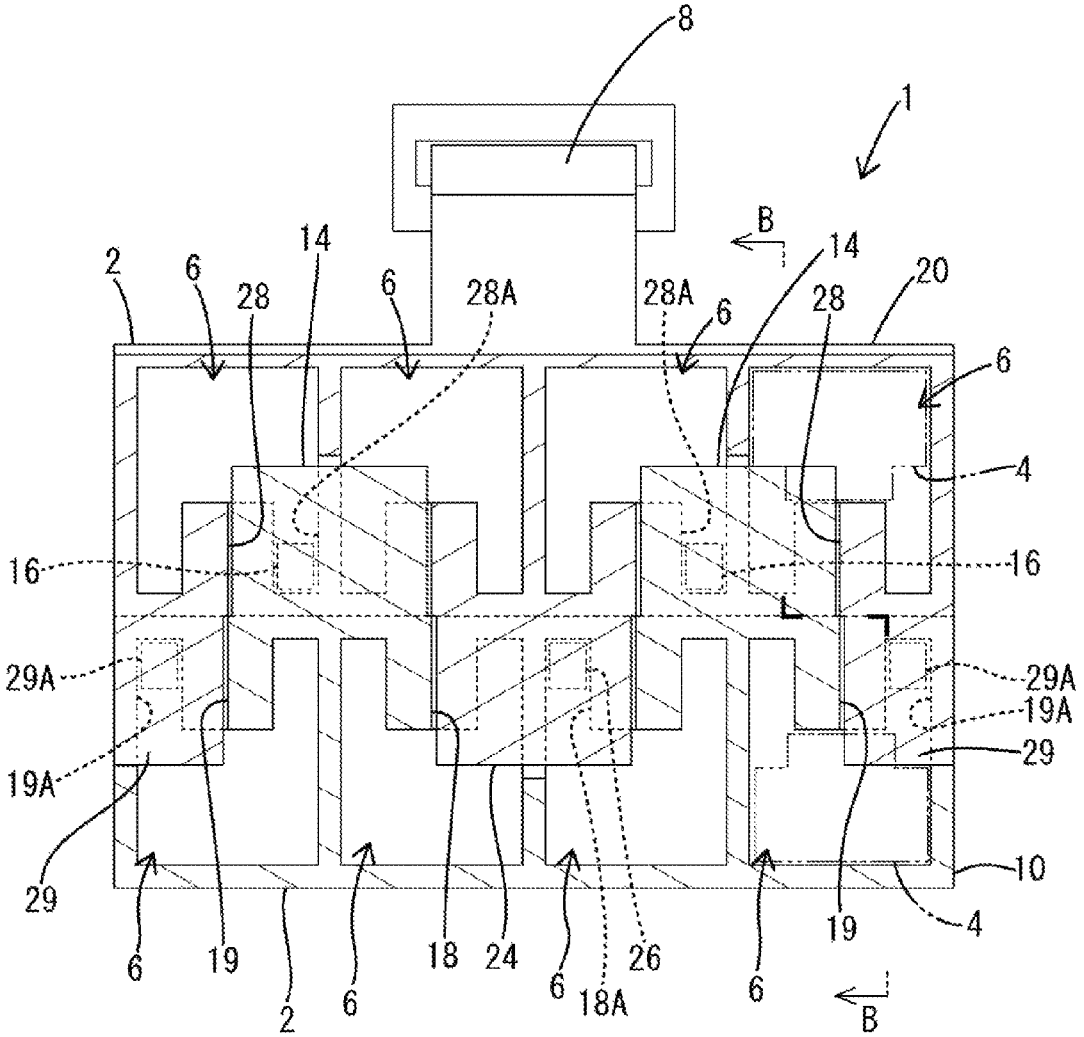
FIG. 4 is a schematic section taken along line A-A in FIG. 3.
Figure 5:
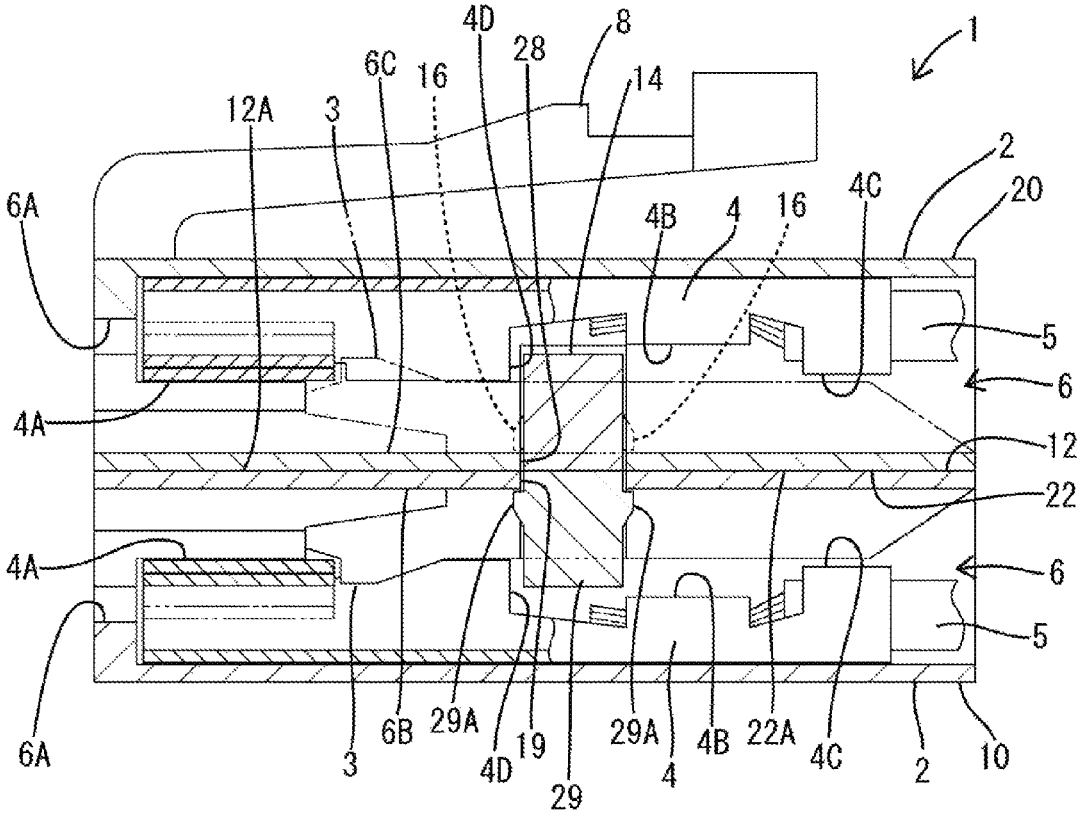
FIG. 5 is a schematic section taken along line B-B in FIG. 4.

FIG. 1 illustrates a laminated connector 1 with a plurality of housings 2 made of synthetic resin and a structure in which these housings 2 are laminated. Each housing 2 has terminal accommodating chambers 6 arranged side by side for accommodating terminal fittings 4 (FIG. 5). The housings 2 include a first housing 10 and a second housing 20 that are coupled to each other to configure the integral laminated connector 1 shown in FIGS. 1 and 3 to 5. In the following description, a left side in FIGS. 3 and 5 is referred to as a front side concerning a front-back direction and a vertical direction is based on FIGS. 3 to 5. Further, in the following description, a width direction is synonymous with a lateral direction of FIG. 4.

As shown in FIG. 5, the terminal accommodating chambers 6 are long and narrow in the front-back direction and open on a rear end of each housing 2. In the embodiment shown in FIGS. 1 and 2, four terminal accommodating chambers 6 are formed in each of the first and second housing 10 and 20. As shown in FIGS. 1 and 4, a two-stage structure composed of upper and lower stages is formed by the terminal accommodating chambers 6 arranged side by side in the width direction in the first housing 10 and the terminal accommodating chambers 6 arranged in the width direction in the second housing 20. Note that the width direction of each housing 2 is a direction corresponding to a "predetermined direction" and perpendicular to the vertical direction and the front-back direction.

FIG. 4 schematically shows a cross-section at a position A-A of FIG. 3 and the terminal fittings 4 accommodated in the terminal accommodating chambers 6 in the upper and lower stages on a right end side are shown conceptually by chain double-dashed line. Further, FIG. 5 is a partial section schematically showing a cross-section at a position B-B of FIG. 4 and showing partial areas in the terminal accommodating chambers 6 as side views. Further, a locking lance 3 in the second housing 20 is shown conceptually by chain double-dashed line in FIG. 5.

As shown in FIG. 5, each terminal accommodating chamber 6 is structured so that the terminal fitting 4 (female terminal fitting) is insertable therein through an opening formed on the rear end, and the inserted terminal fitting 4 is arranged in the terminal accommodating chamber 6 in a state as shown in FIG. 5. Further, a tab insertion hole 6A is formed in a front surface part of each terminal accommodating chamber 6 and can receive a tab of a mating male terminal fitting to be connected to the terminal fitting 4.

The terminal fitting 4 accommodated in each terminal accommodating chamber 6 is formed into a predetermined shape, for example, by applying press working and the like to an electrically conductive metal plate. As shown in FIG. 5, each terminal fitting 4 is formed with a rectangular tubular terminal connecting portion 4A on a front end, and a barrel for connection to a wire 5 is formed on a rear end. The barrel includes a wire barrel 4B to be crimped to a wire core and an insulation barrel 4C to be crimped to a wire coating.

As shown in FIG. 5, a resiliently deformable locking lance 3 is provided in each terminal accommodating chamber 6, and the terminal fitting 4 is locked primarily by this locking lance 3. Each locking lance 3 is cantilevered obliquely forward along an inserting direction of the terminal fitting 4 with a part of an inner wall of the terminal accommodating chamber 6 near a center of the terminal accommodating chamber 6 in the front-back direction as a base. For example, in each terminal accommodating chamber 6 of the second housing 20 arranged on the upper side, the locking lance 3 extends obliquely up toward the front with a bottom wall 6C as the base. Further, in each terminal accommodating chamber 6 of the first housing 10 arranged on the lower side, the locking lance 3 extends obliquely down toward the front with an upper wall 6B as the base. In a state where each terminal fitting 4 is inserted to a proper position in the terminal accommodating chamber 6, as shown in FIG. 5, each locking lance 3 locks the terminal fitting 4 by hooking a rear part of each terminal connecting portion 4A to retain the terminal fitting 4.

Figure 2:
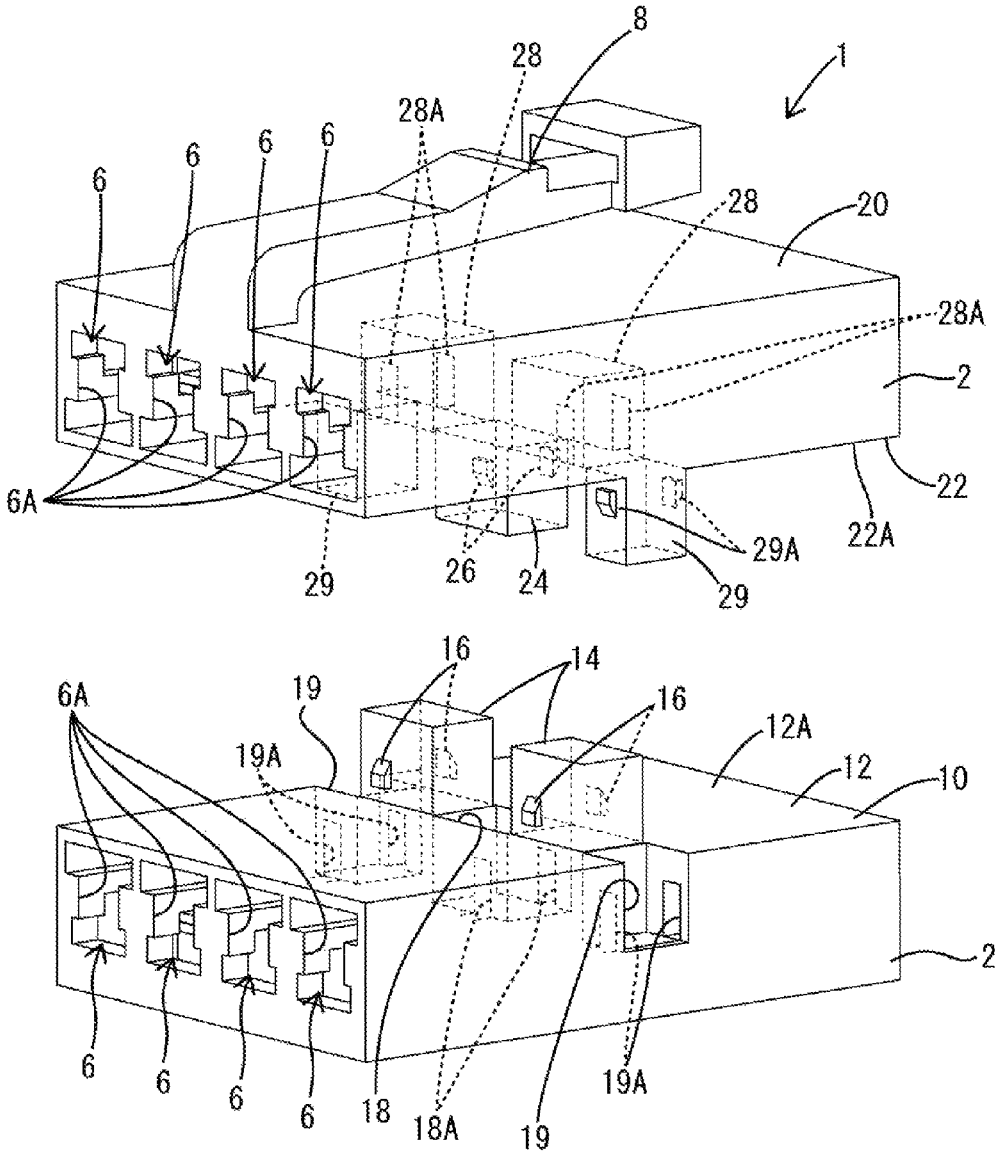
FIG. 2 is a perspective view showing a state where the first and second housings are separated in the laminated connector of FIG. 1.

The respective housings 2 are formed with first projections 14, a second projection 24 and auxiliary projections 29, as shown in FIG. 2, and the terminal fittings 4 (FIG. 5) are locked doubly by these projections.

As shown in FIG. 2, the first projections 14 are arranged on a first facing wall 12 on a side of the first housing 10 to be coupled to the second housing 20 (i.e. upper surface). As shown in FIGS. 2 and 4, the first projections 14 and a first recess 18 are formed alternately in the width direction with the first recess 18 arranged adjacent to the first projections 14.

Specifically, as shown in FIG. 2, two first projections 14 project up from a flat upper surface 12A of the first facing wall 12 and these two first projections 14 are arranged side by side in the width direction while being spaced apart. The first recess 18 is formed between these two first projections 14 and is recessed toward a side opposite to a projecting side of the first projections 14. This first recess 18 is recessed down from the flat upper surface 12A and is sized to fit to the second projection 24 to be described later. Further, auxiliary recesses 19 are formed at outer widthwise sides of and adjacent to the two first projections 14. These auxiliary recesses 19 also are recessed down from the flat upper surface 12A.

As shown in FIGS. 2 and 4, second recesses 28 are arranged on a second facing wall 22 on a side of the second housing 20 to be coupled to the first housing 10 (i.e. lower surface). The second projection 24 and the second recesses 28 are formed alternately in the width direction with the second projection 24 projecting toward a side opposite to the recessed side of the second recesses 28 and at a position adjacent to the second recesses 28.

Specifically, as shown in FIG. 2, two second recesses 28 are recessed up from a flat lower surface 22A of the second facing wall 22 and these two second recesses 28 are arranged side by side in the width direction while being spaced apart. The second recesses 28 are sized to fit to the first projections 14 described above. The second projection 24 is formed between the two second recesses 28 and projects down from the lower surface portion 22A. Further, auxiliary projections 29 are formed at outer widthwise sides of and adjacent to the two second recesses 28. The auxiliary projections 29 also project down from the flat lower surface 22A.

The first housing 10 and the second housing 20 configured as just described are brought closer to each other from a separated state, as shown in FIG. 2, and are coupled, as shown in FIG. 1, by fitting the projections and recesses. Specifically, as shown in FIG. 4, the two first projections 14 on the first housing 10 are inserted respectively into the two second recesses 28 on the second housing 20. Further, the second projection 24 on the second housing 20 is inserted into the first recess 18 on the first housing 10 and, the two auxiliary projections 29 of the second housing 20 are inserted respectively into the two auxiliary recesses 19 of the first housing 10. Thus, the coupled state shown in FIGS. 1, 3 to 5 is obtained to form the integrated laminated connector 1.

As shown in FIG. 4, the two first projections 14 on the first housing 10 are arranged over a plurality of terminal accommodating chambers 6 in the second housing 20 in the coupled state of the laminated connector 1 and regulate movements of the terminal fittings 4 accommodated in the terminal accommodating chambers 6 in a pull-out direction. For example, the first projection 14 on the left side in FIG. 4 is arranged over the two left-most terminal accommodating chambers 6 in FIG. 4 locks the terminal fittings 4 (not shown in FIG. 4) accommodated in those terminal accommodating chambers 6 of the second housing 20 and to regulate movements of those terminal fittings 4 in the pull-out direction. Further, the first projection 14 on the right side in FIG. 4 is arranged over the two right-most terminal accommodating chambers 6 in FIG. 4 and locks the terminal fittings 4 accommodated in the respective terminal accommodating chambers 6 of the second housing 20, and regulate movements of these terminal fittings 4 in the pull-out direction. These locking structures are similar to the locking structures on the upper stage of FIG. 5. Note that the pull-out direction is a direction opposite to the insertion direction of the terminal fitting 4 into the terminal accommodating chamber 6 and hence backward in this embodiment.

As shown in FIG. 5, the terminal fittings 4 accommodated in the respective terminal accommodating chambers 6 of the second housing 20 are arranged in a predetermined face-down state in which locking portions 4D (to be described later) are located on a lower side, and the step-like locking portion 4D faces backward near a central part of the terminal fitting 4 in a length direction of the terminal fitting 4 (front-back direction). The first projections 14 are arranged behind and close to the locking portions 4D and face the locking portions 4D of the terminal fittings 4 in the two terminal accommodating chambers 6 over which it is arranged and functions to regulate backward movements of the respective locking portions 4D and the respective terminal fittings 4.

As shown in FIG. 4, the second projection 24 on the second housing 20 is inserted near a widthwise center of the first housing 10 and is arranged over two terminal accommodating chambers 6 near the widthwise center in the first housing 10. The second projection 24 is arranged to lock the respective terminal fittings 4 (not shown in FIG. 4) accommodated in the terminal accommodating chambers 6 at a position where the second projection 24 is arranged, and functions to regulate movements of these terminal fittings 4 in the pull-out direction. Note that a locking structure at this time is similar to the locking structure on the lower stage side of FIG. 5.

As shown in FIG. 4, the two auxiliary projections 29 formed on the second housing 20 are inserted near opposite widthwise ends of the first housing 10 and are arranged in two terminal accommodating chambers 6 respectively provided on opposite widthwise sides of the first housing 10. Each auxiliary projection 29 is arranged to lock the terminal fitting 4 accommodated in the corresponding terminal accommodating chamber 6 and functions to regulate a movement of that terminal fitting 4 in the pull-out direction. A locking structure at this time is similar to the locking structure on the lower stage side of FIG. 5.

As shown in FIG. 5, the terminal fittings 4 in the respective terminal accommodating chambers 6 of the first housing 10 are arranged in a face-up state with a locking portion 4D located on an upper side, and the step-like locking portion 4D faces back near a central part in a length direction of the terminal fitting 4. The second projection 24 and the auxiliary projections 29 are arranged behind and close to the locking portions 4D and face the locking portions 4D of the terminal fittings 4 in the terminal accommodating chambers 6 to regulate backward movements of the locking portions 4D. Particularly, the second projection 24 is arranged behind and close to both locking portions 4D to face the locking portions 4D of the terminal fittings 4 in the respective terminal accommodating chambers 6 to regulate backward movements of the respective locking portions 4D and the corresponding terminal fittings 4.

The first projections 14, the second projection 24 and the auxiliary projections 29 are formed with resiliently deformable protuberances. The protuberances are caught in the mating housing and function to suppress a relative movement of the projection with respect to the mating recess in a separating direction.

As shown in FIG. 5 and other figures, a protuberance 16 projects forward on a front surface of each first projection 14 formed on the first housing 10 and a protuberance 16 projects backward on a rear surface part of each first projection 14 (see also FIG. 2). As shown in FIG. 5, in an inserted state where the first projection 14 is inserted in the second recess 28, the protuberances 16 formed on the first projection 14 are fit in grooves 28A (see FIGS. 2 and 4) respectively formed on opposite front and rear surfaces of an inner wall part of the second recess 28. Thus, the protuberances 16 are caught in the first housing 10 (specifically, caught in end parts of the grooves 28A) in the inserted state to suppress a relative movement of the first projection 14 with respect to the second recess 28 in the separating direction. The protuberances 16 need to be resiliently deformed to release this catching engagement. Thus, the inserted state is maintained stably unless a strong force to deform the protuberances 16 is applied.

As shown in FIG. 2, a protuberance 26 projects forward on a front surface of the second projection 24 on the second housing 20 and a protuberance 26 projects back on a rear surface of each second projection 24. As shown in FIG. 4, in an inserted state where the second projection 24 is inserted in the first recess 18, the two protuberances 26 formed on the second projection 24 fit respectively in two grooves 18A (see FIG. 2) formed on an inner wall of the first recess 18. Further, a protuberance 29A projects forward and a protuberance 29A projects backward respectively on front and rear surfaces of each auxiliary projection 29. Note that two protuberances 29A formed on the auxiliary projection 29 on a back side are not shown in FIG. 2. In an inserted state where each auxiliary projection 29 is inserted in the corresponding auxiliary recess 19, two protuberances 29A formed on each auxiliary projection 29 are fit respectively in two grooves 19A formed on an inner wall of each auxiliary recess 19.

The protuberances 26 and 29A are caught in the first housing 10 to suppress a relative movement of the second projection 24 with respect to the first recess 18 in the separating direction and relative movements of the auxiliary projections 29 with respect to the auxiliary recesses 19 in the separating direction also in the inserted state where the second projection 24 and the auxiliary projections 29 are inserted in the first housing 10. The protuberances 26 and 29A need to be deformed to release this catching engagement. Thus, the inserted state is maintained stably unless a strong force to resiliently deform the protuberances 26 and 29A is applied.

In this configuration, the second housing 20 is on an upper end of the laminated connector 1 in a laminating direction and a lock arm 8 with a locking portion is formed on an upper surface of the second housing 20 for engaging a housing of a mating connector to be connected to this laminated connector 1 to lock an engaged state. On the other hand, the first housing 10 is on a lower end part of the laminated connector 1 in the laminating direction.

According to the above-described configuration, the terminal fittings 4 accommodated in the second housing 20 can be retained while the housings are coupled by a simple coupling structure of inserting the first projections 14 formed on the first housing 10 into the second recesses 28 formed on the second housing 20. In addition, the first projections 14 of the first housing 10 have a large width to extend over a plurality of terminal accommodating chambers 6 formed in the second housing 20 and act on a plurality of terminal fittings 4 accommodated in those terminal accommodating chambers 6. Thus, the strength of the projections is enhanced. Particularly, since the strength of the projections is maintained even if the housing and the terminal accommodating chambers 6 become smaller in size, a structure advantageous for miniaturization is obtained.

The first projections 14 on the first housing 10 retain the terminal fittings 4 of the second housing 20 and the second projection 24 on the second housing 20 retains the terminal fittings 4 of the first housing 10. Thus, the housings interact so that the projections on each housing retain the terminal fittings 4 of the mating housing, and the terminal fittings 4 can be locked efficiently in both housings. In addition, the first projections 14 and the second projection 24 have a large width to extend over a plurality of terminal accommodating chambers 6 in the mating housing and to lock a plurality of terminal fittings 4. Thus, the strength of any of the projections is enhanced.

At least one of the housings 10, 20 may function as an end housing to be arranged on an end part of the laminated connector 1 in the laminating direction. Thus, a dedicated lid with a locking structure but no terminal accommodating chambers 6 is not required on the end part in the laminating direction, and a reduction of the number of components and miniaturization are realized.

Further, the resiliently deformable protuberances 16 are formed on the outer surfaces of the first projections 14 and are inserted in the second recesses 28 to catch in the first housing 10, thereby suppressing relative movements of the first projections 14 with respect to the second recesses 28 in the separating direction. Thus, the projections retain the terminal fittings 4, and also parts of the projections maintain a fitting structure. Thus, the coupled state of the housings is maintained stably in the absence of a dedicated component by the fitted state of the projections and the recesses and the catching engagement of the protuberances. Therefore, the structure for maintaining the coupling of the housings is not large and complicated.

Further, as shown in FIG. 2, the first projections 14 on the first housing 10 and the second projection 24 and the auxiliary projections 29 on the second housing 20 are formed with the protuberances 26 and 29A that function similar to the protuberances 16 of the first projections 14. Thus, the aforementioned effect is further enhanced.

Other embodiments are briefly described below.

The laminated connector has the first and second housings 10, 20 placed one over the other is illustrated in the above embodiment. However, a structure having three or more layers in which housing(s) other than these are laminated may be adopted.

The projection of the second housing 20 may not extend over a plurality of terminal accommodating chambers 6 in the first housing 10 or the second housing 20 may be configured not to be inserted partly into the first housing 10. In this case, for example, another housing may be laminated below the first housing 10 and this housing may be inserted partly into the first housing 10 to retain the terminal fittings 4 in the first housing 10.

The projection formed on the first housing 10 may extend over three or more terminal accommodating chambers 6 in the second housing 20.

The number of the terminal accommodating chambers 6 in each housing is not limited to four and may be five or more.

LIST OF REFERENCE SIGNS

1 . . . laminated connector
2 . . . housing
4 . . . terminal fitting
6 . . . terminal accommodating chamber
10 . . . first housing
12 . . . first facing wall
14 . . . first projection
16 . . . protuberance
18 . . . first recess
20 . . . second housing
22 . . . second facing wall
24 . . . second projection
26 . . . protuberance
28 . . . second recess

What is claimed is:

1. A laminated connector, comprising:

a first housing with terminal accommodating chambers arranged side by side and configured for accommodating terminal fittings, the first housing having a first facing wall and at least one first projection formed on the first facing wall; and a second housing with terminal accommodating chambers arranged side by side and configured for accommodating terminal fittings, the second housing having a second facing wall formed with at least one second recess communicating with a plurality of the terminal accommodating chambers in the second housing, wherein, the first housing is coupled to the second housing with the first facing wall placed on the second facing wall and with the at least one first projection penetrating the at least one second recess and with the at least one first projection having a width to project into the plurality of terminal accommodating chambers of the second housing that communicate with the respective second recess for regulating movements in a pull-out direction of the respective terminal fittings accommodated in the terminal accommodating chambers of the second housing that communicate with the respective second recess;

the first housing further has a first recess in the first facing wall and communicating with the terminal accommodating chambers therein, the first recess being adjacent the at least one first projection;

the second housing further has a second projection on the second facing wall and adjacent to the second recess; and the second projection penetrates the second recess and projects into the respective terminal accommodating chambers of the first housing for regulating movements of the respective terminal fittings accommodated in the terminal accommodating chambers of the first housing in a pull-out direction.

2. The laminated connector of claim 1, wherein a resiliently deformable protuberance is formed on an outer surface of the first projection; and the protuberance on the first projection is caught in the second housing in an inserted state where the first projection in the second recess, thereby regulating a relative movement of the projection with respect to the recess in a separating direction.

3. The laminated connector of claim 1, wherein:

the at least one first projection comprises plural first projections formed on the first facing wall of the first housing;

the at least one second recess comprises plural second recesses, each of the second recesses communicating with a plurality of the terminal accommodating chambers in the second housing; and each of the first projections penetrating one of the second recesses and having a width to project into the plurality of terminal accommodating chambers of the second housing that communicate with the respective second recess for regulating movements in a pull-out direction of the respective terminal fittings accommodated in the terminal accommodating chambers of the second housing that communicate with the respective second recess.

4. A laminated connector, comprising:

a first housing with terminal accommodating chambers arranged side by side and configured for accommodating terminal fittings, the first housing having a first facing wall and at least one first projection formed on the first facing wall, the first housing further having a first recess in the first facing wall and communicating with the terminal accommodating chambers therein, the first recess being adjacent the at least one first projection; and a second housing with terminal accommodating chambers arranged side by side and configured for accommodating terminal fittings, the second housing having a second facing wall formed with at least one second recess communicating with the terminal accommodating chambers in the second housing, the second housing further having a second projection on the second facing wall and adjacent to the second recess, wherein the first housing is coupled to the second housing with the first facing wall placed on the second facing wall and with the at least one first projection penetrating the at least one second recess and projecting into the respective terminal accommodating chambers of the second housing for regulating movements of the respective terminal fittings accommodated in the terminal accommodating chambers of the second housing in a pull-out direction, and the second projection penetrates the second recess and projects into the respective terminal accommodating chambers of the first housing for regulating movements of the respective terminal fittings accommodated in the terminal accommodating chambers of the first housing in a pull-out direction.

5. A laminated connector, comprising:

a first housing with terminal accommodating chambers arranged side by side and configured for accommodating terminal fittings, the first housing having a first facing wall and at least one first projection formed on the first facing wall; and a second housing with terminal accommodating chambers arranged side by side and configured for accommodating terminal fittings, the second housing having a second facing wall formed with at least one second recess communicating with the terminal accommodating chambers in the second housing, wherein:

the first housing is coupled to the second housing with the first facing wall placed on the second facing wall and with the at least one first projection penetrating the at least one second recess and projecting into the respective terminal accommodating chambers of the second housing for regulating movements of the respective terminal fittings accommodated in the terminal accommodating chambers of the second housing in a pull-out direction;

a resiliently deformable protuberance is formed on an outer surface of the first projection; and the protuberance on the first projection is caught in the second housing in an inserted state where the first projection in the second recess, thereby regulating a relative movement of the projection with respect to the recess in a separating direction.

* * * * *